US008118983B1

(12) United States Patent
Anderson et al.

(10) Patent No.: US 8,118,983 B1
(45) Date of Patent: Feb. 21, 2012

(54) SYSTEM FOR INHIBITING CORROSION OF SUBMERGED COMPONENTS IN A MARINE PROPULSION SYSTEM

(75) Inventors: Kevin R. Anderson, Fond du Lac, WI (US); Christopher J. Misorski, Fond du Lac, WI (US); Gregory L. Fugar, Oshkosh, WI (US); Steven J. Gonring, Slinger, WI (US)

(73) Assignee: Brunswick Corporation, Lake Forest, IL (US)

( * ) Notice: Subject to any disclaimer, the term of this patent is extended or adjusted under 35 U.S.C. 154(b) by 261 days.

(21) Appl. No.: 12/687,931

(22) Filed: Jan. 15, 2010

(51) Int. Cl.
*C23F 13/20* (2006.01)
*C23F 13/22* (2006.01)
*C23F 13/04* (2006.01)

(52) U.S. Cl. ..... 204/196.11; 204/196.1; 204/196.01; 204/196.02; 204/196.04; 204/196.06; 204/196.07; 204/196.21; 204/196.23; 204/196.24; 204/196.25; 204/196.26; 204/196.36; 204/196.37

(58) Field of Classification Search ..... 204/196.01, 204/196.02, 196.04, 196.06, 196.07, 196.1, 204/196.11, 196.21, 196.23, 196.26, 196.36, 204/196.37, 196.24, 196.25
See application file for complete search history.

(56) References Cited

U.S. PATENT DOCUMENTS

| | | | | |
|---|---|---|---|---|
| 2,571,062 | A | 10/1951 | Robinson et al. | |
| 3,242,064 | A | 3/1966 | Byrne | |
| 3,327,214 | A | 6/1967 | Allen et al. | |
| 3,953,742 | A * | 4/1976 | Anderson et al. | 204/196.03 |
| 4,322,633 | A * | 3/1982 | Staerzl | 204/196.02 |
| 4,381,981 | A * | 5/1983 | Maes | 204/196.04 |
| 4,445,989 | A | 5/1984 | Kumar et al. | |
| 4,492,877 | A | 1/1985 | Staerzl | |
| 4,528,460 | A | 7/1985 | Staerzl | |
| 4,592,818 | A * | 6/1986 | Cavil et al. | 204/196.02 |
| 4,872,860 | A | 10/1989 | Meisenburg | |
| 5,627,414 | A | 5/1997 | Brown et al. | |
| 5,716,248 | A | 2/1998 | Nakamura | |
| 5,747,892 | A | 5/1998 | Staerzl | |
| 5,840,164 | A | 11/1998 | Staerzl | |
| 6,183,625 | B1 * | 2/2001 | Staerzl | 205/727 |
| 6,547,952 | B1 | 4/2003 | Staerzl | |
| 6,559,660 | B1 * | 5/2003 | Staerzl | 324/712 |
| 7,064,459 | B1 * | 6/2006 | Staerzl | 307/95 |
| 7,381,312 | B1 | 6/2008 | Misorski et al. | |
| 7,387,556 | B1 | 6/2008 | Davis | |
| 2006/0065551 | A1 * | 3/2006 | Howard et al. | 205/740 |
| 2006/0213765 | A1 * | 9/2006 | Mizuno et al. | 204/196.01 |

* cited by examiner

*Primary Examiner* — Bruce Bell
(74) *Attorney, Agent, or Firm* — William D. Lanyi

(57) ABSTRACT

A corrosion inhibiting system is provided with the ability to allow both primary and secondary portions of the circuit to be used in the alternative without having the primary and secondary systems interfere with each other by operating at the same time. By incorporating a continuity controller, such as a switch or a diode to selectively disconnect the sacrificial anode from the circuit, the primary and secondary systems can both be provided on a marine vessel, but used independently from each other. In that way, the primary and secondary corrosion inhibiting systems are prevented from interfering with each other during normal operation.

20 Claims, 6 Drawing Sheets

SYSTEM FOR INHIBITING CORROSION OF SUBMERGED COMPONENTS IN A MARINE PROPULSION SYSTEM

BACKGROUND OF THE INVENTION

1. Field of the Invention

The present invention is generally related to a system for inhibiting the corrosion of components within a marine propulsion system and, more particularly, to a system with primary and secondary corrosion inhibiting devices that are configured to work cooperatively with each other while avoiding the disadvantageous results that can sometimes occur when two cathodic systems are both used on a common marine vessel.

2. Description of the Related Art

Those who are skilled in the art of marine propulsion systems are familiar with various techniques that can be used to inhibit the corrosion of submerged components through the formation of galvanic circuits. Those skilled artisans are also familiar with various techniques used to avoid the formation of those galvanic circuits that can otherwise degrade and erode the surface of metallic components used in marine propulsion systems.

U.S. Pat. No. 2,571,062, which issued to Robinson et al. on Oct. 9, 1951, describes a sacrificial anode system for protecting metals in seawater. The tendency for structures of steel and similar metals, when immersed in seawater, to undergo serious corrosion can be offset by cathodic protection. In this process the structure is made the cathode in an electric circuit using the seawater as an electrolyte. If sufficient current is supplied, the structure can be kept from corroding.

U.S. Pat. No. 3,242,064, which issued to Byrne on Mar. 22, 1966, describes a cathodic protection system. It relates to corrosion reduction systems in which the direct current supplied to the surface to be protected, such as the hull of a ship, is automatically varied in accordance with the protective conditions on the hull, as monitored by a sensing half-cell.

U.S. Pat. No. 3,327,214, which issued to Allen et al. on Jun. 20, 1967, describes an electronic current meter having linear response. It relates to an electronic meter and, more particularly, to one used in procedures for determining the current requirements for cathodic protection of well casings and the like. The current required for the cathodic protection of well casings and the like can be determined by the polarization curve method. In this method, cathodic currents are applied to the well casing in discreet increments. At each current increment, the current is momentarily interrupted and the casing-to-soil polarization potential, with respect to a reference electrode placed in the earth some distance from the well head, is determined. The difference between these measured polarization potentials with each increase in current are normally of the order of a few millivolts.

U.S. Pat. No. 3,953,742, which issued to Anderson et al. on Apr. 27, 1976, discloses a cathodic protection monitoring apparatus for a marine propulsion device. The monitor is coupled to an impressed current cathodic protection circuit used for corrosion protection of a submerged marine drive. The cathodic protection circuit includes one or more anodes and a reference electrode mounted below the water line and connected to an automatic controller for supplying an anode current which is regulated in order to maintain a predetermined reference potential on the protected structure. A switch selectively connects a light emitting diode (LED) lamp or other light source between the controller output and ground so that the controller current may, when tested, be used to operate the light source in order to confirm that power is available to the anode.

U.S. Pat. No. 4,322,633, which issued to Staerzl on Mar. 30, 1982, discloses a marine cathodic protection system. It maintains a submerged portion of a marine drive unit at a selected potential to reduce or eliminate corrosion thereto. An anode is energized to maintain the drive unit at a preselected constant potential in response to the sensed potential at a closely located reference electrode during normal operations. Excessive current to the anode is sensed to provide a maximum current limitation. An integrated circuit employs a highly regulated voltage source to establish precise control of the anode energization.

U.S. Pat. No. 4,445,989, which issued to Kumar et al. on May 1, 1984, describes a ceramic anode for corrosion protection. The anode is useful in corrosion protection comprising a metallic substrate having an applied layer thereon of a ferrite or a chromite, is described. The layer having metallic is electronic conductivity and a thickness of at least 10 mils is used.

U.S. Pat. No. 4,492,877, which issued to Staerzl on Jan. 8, 1985, discloses an electrode apparatus for cathodic protection. The apparatus is provided for mounting an anode and reference electrode of a cathodic protection system on an outboard drive unit. The apparatus includes an insulating housing on which the anode and reference electrode are mounted and a copper shield mounted between the anode and electrode to allow them to be mounted in close proximity to each other. The shield is electrically connected to the device to be protected and serves to match the electrical field potential at the reference electrodes to that of a point on the outboard drive unit and remote from the housing.

U.S. Pat. No. 4,528,460, which issued to Staerzl on Jul. 9, 1985, discloses a cathodic protection controller. A control system for cathodically protecting an outboard drive unit from corrosion includes an anode and a reference electrode mounted on the drive unit. Current supplied to the anode is controlled by a transistor, which in turn is controlled by an amplifier. The amplifier is biased to maintain a relatively constant potential on the drive unit when operated in either fresh or salt water.

U.S. Pat. No. 4,872,860 which issued to Meisenburg on Oct. 10, 1989, discloses a sacrificial anode for marine propulsion units. The anode is disposed in association with the trim cylinder unit of a marine propulsion device and is positioned in the previously unused area between the aft cylinder end and the rodeye or the like on the piston rod end. More specifically, the anode is in the form of an elongated generally cylindrical member of a diameter approximately that of the trim cylinder to provide improved mass characteristics, and is deeply grooved to thus provide ribs which enhance the working surface area. The anode may be attached to an extended pilot member which is suitably secured within the aft end of the trim cylinder.

U.S. Pat. No. 5,627,414, which issued to Brown et al. on May 6, 1997, describes an automatic marine cathodic protection system using galvanic anodes. The system provides a controlled and optimum amount of cathodic protection against galvanic corrosion on submerged metal parts. Intermittently pulsed control circuitry enables an electro-mechanical servo system to control a resistive element interposed between the sacrificial anodes and the electrically bonded underwater parts. In an active mode of operation a current is applied directly to the anodes to quickly establish the proper level of correction which is maintained during the passive mode.

U.S. Pat. No. 5,716,248, which issued to Nakamura on Feb. 10, 1998, describes a sacrificial anode for marine propulsion units. Various anode arrangements for marine propulsion units are described wherein the sacrificial anode is juxtaposed to the trim tab and is detachably connected to the lower unit housing by fastening means which can be removed from the upper surface thereof. In one embodiment, the trim tab is detachably connected to the sacrificial anode and connected to the outer housing portion through the sacrificial anode.

U.S. Pat. No. 5,747,892, which issued to Staerzl on May 5, 1998, discloses a galvanic isolator fault monitor. A system and method for testing and monitoring the operation of a galvanic isolator is disclosed. The galvanic isolator is positioned between shore ground and boat ground to prevent the flow of destructive galvanic currents between the shore ground and the boat ground. The monitoring system transmits a test current through the galvanic isolator at specific time internals to test the effectiveness of the galvanic isolator. The monitoring system includes a first counter that outputs an enabling signal after a desired period of time. The enabling signal allows a test current to flow through the galvanic isolator for a brief period of time determined by a second counter.

U.S. Pat. No. 5,840,164, which issued to Staerzl on Nov. 24, 1998, discloses a galvanic isolator. It is intended to protect against galvanic corrosion of a submersible metal marine drive. The galvanic isolator is positioned between shore ground and boat ground to prevent the flow of destructive galvanic currents between those grounds while maintaining the safety function of neutral ground. The galvanic isolator of the invention includes a blocking element positioned between the boat ground and the shore ground that can be switched between an opened and a closed state by a trigger circuit. The trigger circuit closes the blocking element when the voltage difference between the boat ground and the shore ground exceeds a threshold value, such as 1.4 volts. During operation of the galvanic isolator during the high fault current situation, power is dissipated only by the blocking element, rather than by the combination of the blocking element and the trigger device. In this manner, the galvanic isolator reduces the amount of power dissipated during high current conditions and therefore reduces the amount of heat generated by the galvanic isolator.

U.S. Pat. No. 6,183,625, which issued to Staerzl on Feb. 6, 2001, discloses a marine galvanic protection monitor. The system uses two annunciators, such like light emitting diodes, to alert a boat operator of the current status of the boat's galvanic protection system. A reference electrode is used to monitor the voltage potential at a location in the water and near the component to be protected. The voltage potential of the electrode is compared to upper and lower limits to determine if the actual sensed voltage potential is above the lower limit and below the upper limit. The two annunciator lights are used to inform the operator if the protection is proper or if the component to be protected is either being overprotected or underprotected.

U.S. Pat. No. 6,547,952, which issued to Staerzl on Apr. 15, 2003, discloses a system for inhibiting fouling of an underwater surface. An electrically conductive surface is combined with a protective surface of glass in order to provide an anode from which electrons can be transferred to seawater for the purpose of generating gaseous chlorine on the surface to be protected. Ambient temperature cure glass (ATC glass) provides a covalent bond on an electrically conductive surface, such as nickel-bearing paint. In this way, both hulls, submerged portions of outboard motors, and submerged portions of sterndrive systems can be protected effectively from the growth of marine organisms, such as barnacles.

U.S. Pat. No. 7,064,459, which issued to Staerzl on Jun. 20, 2006, discloses a method of inhibiting corrosion of a component of a marine vessel. A method for inhibiting galvanic corrosion of marine propulsion components impresses an electronic current into the protected component and causes the protected component to act as a cathode in a galvanic circuit which comprises a conductor, such as a ground wire connected between the protected component and an electrical conductor which is external to the marine vessel on which the protective component is attached. The electrical conductor can be a ground wire of an electrical power cable connected between the marine vessel and the shore ground. The sea bed is caused to act as an anode in the galvanic circuit, with varying voltage potentials existing within the water between the sea bed and the protected component. The system can be a closed loop control circuit using a voltage sensed by an electrode, or an open loop circuit that provides current pulses based on empirical data.

U.S. Pat. No. 7,381,312, which issued to Misorski et al. on Jun. 3, 2008, discloses a cathodic protection system for a marine propulsion device with a ceramic conductor. A ceramic conductor is supported by an electrically insulative support member for attachment directly to a marine propulsion drive and for use as either an anode or electrode in a corrosion prevention system. The ceramic conductor is received within a depression formed in a surface of the electrically insulative support member and the exposed surface of the ceramic conductor can be offset from or coplanar with an exposed surface of the electrically insulative support member. The ceramic conductor can comprise oxides of iridium, tantalum and titanium that are formed as a coating on a titanium substrate.

U.S. Pat. No. 7,387,556, which issued to Davis on Jun. 17, 2008, discloses an exhaust system for a marine propulsion device having a driveshaft extended vertically through a bottom portion of a boat hull. The exhaust system directs a flow of exhaust gas from an engine located within the marine vessel, and preferably within a bilge portion of the marine vessel, through a housing which is rotatable and supported below the marine vessel. The exhaust passageway extends through an interface between the stationary and rotatable portions of the marine propulsion device, through a cavity formed in the housing, and outwardly through hubs of pusher propellers to conduct the exhaust gas away from the propellers without causing a deleterious condition referred to as ventilation.

The patents described above are hereby expressly incorporated by reference in the description of the present invention.

Those skilled in the art of marine propulsion systems and corrosion inhibiting devices are familiar with the fact that two basic approaches have been used for many years to inhibit galvanic corrosion. One technique involves the use of a sacrificial anode which, as the name implies, uses an anode that is sacrificed in order to protect a more important or valuable device, such as an aluminum marine drive unit. The sacrifice involves the gradual corrosion and, potentially, the eventual disappearance of the material of which the sacrificial anode is made. This material typically comprises zinc, magnesium, or aluminum because of their relative potential difference to the material that they are protecting which can be summarized in a table called the galvanic series. A circuit using this technique typically selects a material with an electrode potential that is more negative than the material of the component being protected. As an example, using the values from Table III, if the goal is to protect an iron component (electrode potential of −700 mV) it would be possible to use an aluminum anode (electrode potential of −1075 mV) as the sacrificial component because the aluminum would sacrifice itself by giving up electrons to protect the iron. Another example could use a zinc anode (electrode potential of −1150 mV) in order to protect a copper device (electrode potential of −300 mV).

Another technique that can be used to inhibit galvanic corrosion is a system that impresses a current into the protected component in order to raise its potential and cause it to act as a cathode in the circuit which connects the protected component (i.e. the cathode) electrically with the sacrificial component (i.e. the anode) with a conductor (i.e. a wire or other current path between the protected component and the protecting component). This forms a half cell. Another half cell is made up of the sacrificial and protected components along with an electrolyte (i.e. water) in which they are both submerged. The conductor provides a path through which electrons can flow from the anode to the cathode as the ions move through the electrolyte from the cathode to the anode.

Since both of these techniques are available to the designer for the purpose of inhibiting galvanic corrosion, in many systems both techniques are used in the same design. This provides both primary and secondary corrosion inhibiting systems. However, as will be described in greater detail below, the presence of both systems can lead to disadvantageous interactions in which the efficiency of the total system is decreased. As will be described in greater detail below, it would be significantly beneficial if a system could be provided to allow the use of primary and secondary systems in a way which avoids the disadvantageous interactions between them. It would also be beneficial if the system could also be directed toward the goal of avoiding the counterproductive interference between primary and secondary systems in the ways that are prevalent in the prior art.

SUMMARY OF THE INVENTION

A corrosion inhibiting system made in accordance with a preferred embodiment of the present invention comprises a primary corrosion protection device configured to maintain a marine propulsion unit at a selected potential wherein the marine propulsion unit is made of a first material, a secondary corrosion protection device made of a second material wherein the first and second materials are dissimilar materials, an electrical conductor connected in electrical communication between the first material of the marine propulsion unit and the second material of the secondary corrosion protection device, and a continuity controller connected in electrical communication with the electrical conductor between the first material of the marine propulsion unit and the second material of the secondary corrosion protection device.

The primary corrosion protection device is configured to maintain the marine propulsion unit at the selected potential by supplying electrical energy from a direct current source to a submergible electrode located adjacent to the marine propulsion unit, wherein the secondary corrosion protection device is a submergible anode and wherein the second material is selected to act as a sacrificial anode and cathodically protect the first material when the first and second materials are connected together in electrical communication, and wherein the electrical conductor comprises an electrically conductive cable which extends at least partially between the first and second materials. It should be understood that by the term "electrically conductive cable", the description of the preferred embodiments of the present invention is intended to include any type of component or device which connects various portions of the system together electrically so that electrons can travel between the first and second materials.

The continuity controller can be a switch which is controllable as a function of the operability of the cathodic protection device and the cathodic protection device can be configured to open the switch to disconnect the submergible anode from the marine propulsion unit when the marine propulsion unit is operating effectively to maintain the marine propulsion unit at the selected potential. The cathodic protection device can also be configured to close the switch to connect the submergible anode in electrical communication with the marine propulsion unit when the marine propulsion unit is not maintaining the marine propulsion unit at the selected potential. The cathodic protection device is configured, in preferred embodiments of the present invention, to maintain the marine propulsion unit at the selected potential when the switch is closed.

Alternatively, the continuity controller can be a diode which is configured to limit the magnitude of an electric current flowing to the anode as a function of the relative potentials of the submergible marine propulsion unit and the submergible anode. The first material can be a metal, which is intended to be protected, and is typically selected from the group consisting of bronze, aluminum, and stainless steel and the second material can be a metal, which is intended to be sacrificed, and is typically selected from the group consisting of zinc, magnesium, and aluminum.

In certain embodiments of the present invention, it can further comprise an alarm device configured to provide visual or audible notification of the continuity controller being activated to connect the submergible anode in electrical communication with the marine propulsion unit. This alarm device can vary from a simple notification to the operator of a vessel by activating a signal light, such as an LED, or writing a message on a display screen. Alternatively, the alarm device can be an audible notification device such as a siren or computer generated sound.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
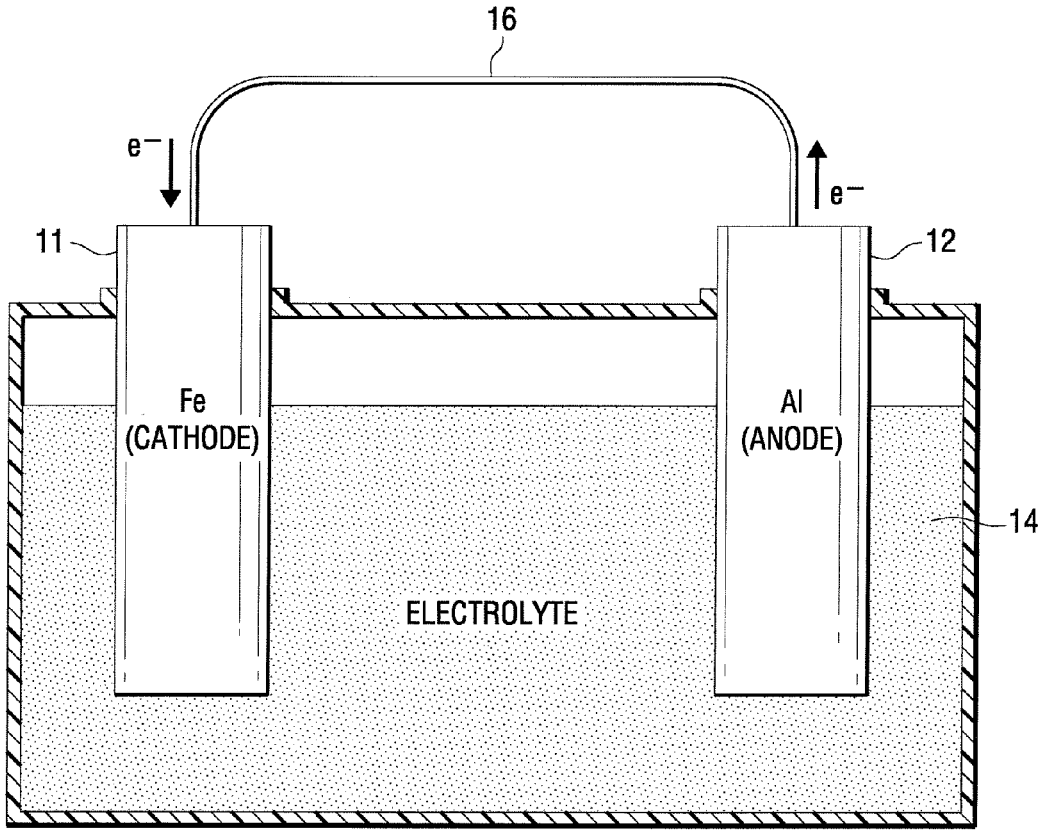
FIG. 1 illustrates a simple battery formed through the use of dissimilar metals disposed in an electrolyte and provided with a conductor connected between them.

Throughout the description of the preferred embodiment of the present invention, like components will be identified by like reference numerals.

In order to understand the characteristics and advantages of the preferred embodiments of the present invention, it is helpful if it is understood how dissimilar metals react when placed in an electrolyte and provided with a path through which electrons can travel. FIG. 1 illustrates a basic exemplary arrangement with a first electrode 11, such as iron, and a second electrode 12, such as aluminum. These two metals are dissimilar and act as the cathode and anode, respectively, when placed in the electrolyte 14. In order for corrosion to occur, a connection 16 must be provided so that electrons can travel from the anode 12 to the cathode 11. In essence, the configuration shown in FIG. 1 forms a basic battery. When dissimilar metals are electrically connected together, as in the arrangement of FIG. 1, corrosion of the anode can occur very rapidly.

It is common for a marine propulsion system to incorporate an aluminum driveshaft housing in combination with a stainless steel propeller with both of those dissimilar metals being immersed in seawater which acts as the electrolyte. If the stainless steel propeller and aluminum housing are electrically connected together, as they typically are in a marine propulsion unit, it forms a battery with electrical current flowing between the dissimilar metals. The corrosion associated with this type of connection between dissimilar metals is called galvanic corrosion. The aluminum housing loses material in the form of aluminum ions, through the electrolyte, and electrons flow from the aluminum housing through various electrical connections, as symbolized by wire 16 in FIG. 1, to the stainless steel propeller. The metal supplying the electrons is called the anode and the metal receiving them is called the cathode. In order for galvanic corrosion to occur, there must be an electrical circuit. In other words, a path must exist for the electrons to travel between the two dissimilar metals and there must also be a path through the electrolyte for the ions to travel. In addition, the chemical reactions at the cathode and anode typically also require the presence of oxygen in the electrolyte 14. In marine applications, it is very typical to have a combination of metals such as steel, aluminum, copper alloys and other metals. Table I, shown below, lists a variety of pure elements according to their electromotive force (emf), or electrode potential when immersed in a solution containing one gram atomic weight of their respective ions. In this case, every potential is referenced to hydrogen which is arbitrarily defined as zero. It should be understood that the voltage magnitude associated with any particular metal depends on the particular procedures used in measuring the potential for a given metal, including the environment in which the measurements were made. The number of electrons (e.g. 1e, 2e, 3e) shown for some of the table entries refers to the number of electrons involved in the exchange. Certain materials in the electrode column of the table appear more than once. This occurs because the particular metal can give up different numbers of electrons, depending on the chemical reaction that occurs. In Table I, for example, gold is shown at the top of the list of materials in the electrode column as providing either one or three electrons. Since these two possible reactions result in different electrode potentials, both are listed in the table and identified by the number of electrons given up to result in the particular magnitude of electrode potential. However, as described above, the precise magnitude of the electrode potential, or activity, of a particular metal is not as important as the relative positions in the table of the metals being considered. For the purpose of this description, it should be understood that the precise magnitude of the activity shown in Table I is not as important as the relative place of each of the metals in the table. In other words, the relative activity of the metals in comparison to other metals is more important than the absolute magnitude of the electrode potential in determining the expected response when any two metals are placed in a circuit similar to that shown in FIG. 1.

TABLE I

| ELECTRODE | ELECTRODE POTENTIAL |
|---|---|
| GOLD 1e | 1.692 |
| GOLD 3e | 1.498 |
| CHLORINE | 1.35827 |
| OXYGEN, HYDROGEN (acid) 4e | 1.229 |
| PLATINUM | 1.18 |
| PALLADIUM | 0.951 |
| SILVER | 0.7996 |
| OXYGEN, HYDROGEN (ACID) 2e | 0.695 |
| COPPER 1e | 0.521 |
| OXYGEN, WATER 4e | 0.401 |
| COPPER 2e | 0.34 |
| HYDROGEN | 0 |
| IRON 3e | −0.037 |
| LEAD | −0.1262 |
| TIN | −0.1375 |
| OXYGEN, WATER 2e | −0.146 |
| NICKEL | −0.257 |
| COBALT | −0.28 |
| CADMIUM | −0.403 |
| IRON 2e | −0.447 |
| CHROMIUM 3e | −0.744 |
| ZINC | −0.7618 |
| WATER | −0.8277 |
| CHROMIUM 2e | −0.913 |
| MANGANESE | −1.185 |
| TITANIUM 3e | −1.37 |
| TITANIUM 2e | −1.63 |
| ALUMINUM | −1.662 |
| MAGNESIUM 2e | −2.372 |
| MAGNESIUM 1e | −2.7 |
| SODIUM | −2.71 |
| CALCIUM 2e | −2.868 |
| POTASSIUM | −2.931 |
| LITHIUM | −3.0401 |
| CALCIUM 1e | −3.8 |

Table II also shows the relative position of numerous metal alloys according to their activity in relation to other metals. A metal alloy is a combination of one metal with other metals or elements. In Table II, the precise magnitude of the electrode potential is not shown. Table II contains many additional metal alloys. For example, many varieties of stainless steel are shown with numerous varieties of aluminum. The purpose of Table II is to show that certain minor variations in the type of alloy can affect the position in the table of the alloy and the relative activity of the metal in comparison to other metals.

TABLE II

| ELECTRODE |
|---|
| Graphite |
| Gold |
| Silver |
| Titanium 6AI, 4V (anneal) |
| Titanium 6AI, 4V (solution treated and aged) |
| A286 (passive) |
| Stainless steel 316L (passive) |
| Stainless steel 301 (passive) |
| Stainless steel 304 (passive) |
| Silicon Bronze 655 |
| Stainless steel 17-7PH (passive) |
| Stainless steel 316 (active) |
| Monel 400 |
| Bronze, Phosphor 534 (B-1) |
| Admiralty brass |
| Copper-nickel 715 |
| Red Brass |
| Stainless steel 316L (active) |
| Yellow Brass |
| Brass, Naval, 464 |
| Stainless steel 17-7PH (active) |
| Stainless steel 304 (active) |

TABLE II-continued

| ELECTRODE |
|---|
| Stainless steel 301 (active) |
| Chromium (Plated) |
| Nickel (plated) |
| Copper (plated, cast, or wrought) |
| Iron (cast) |
| Steel 1010 |
| Lead |
| Tin (plated) |
| Al 5052-H16 |
| Al 2024-T4 |
| Al 6061-0 |
| Al 7075-T6 |
| Al A360 (die cast) |
| Al 6061-T6 |
| Al 3003-H25 |
| Al 1100-0 |
| Al 5052-H32 |
| Al 5052-H12 |
| Al 5052-0 |
| Cadmium (plated) |
| Zinc (hot-dip, die cast, or plated) |
| Mg alloy AZ-31B |
| Magnesium |

Table III, shown below, contains an abbreviated group of metals selected to show certain specific examples which will be discussed below. Each of the metals shown in Table III is identified by its potential, shown in millivolts. As mentioned above, marine applications typically use many different types of metals in combination with each other and place those metals within a common electrolyte, such as the body of water in which a marine vessel is operated. This can lead to numerous opportunities for galvanic corrosion to occur. As an example, if bronze is connected electrically to aluminum in a common electrolyte, such as seawater, the aluminum will become the anode in the circuit and, as a result, the aluminum will be corroded. However, as also shown in Table III below, zinc is more active than the aluminum. As a result, zinc anodes can be used to protect the aluminum. The zinc, because of its position in the table below, corrodes in preference to the aluminum and can thus be used as a sacrificial anode to protect the aluminum.

TABLE III

| MATERIAL | POTENTIAL (mV) vs. SCE reference electrode |
|---|---|
| Zinc Anode Alloy | −1150 |
| Aluminum-Indium Alloy | −1075 |
| MerCathode maximum output | −940 |
| Aluminum-Gallium Alloy | −850 |
| Stainless Steel (various alloys) | −50 to −600 |
| Graphite | 200 to 300 |
| Bronze | −150 to −450 |
| Brass | −250 to −450 |
| Copper | −300 to −375 |
| Mild Steel | −600 to −710 |
| Aluminum | −740 to −1000 |
| Magnesium | −1500 to −1700 |

As described above in conjunction with Tables I, II, and III, it can be seen that corrosion is an electrolytic action that involves an exchange of both electrons and ions. It can occur either between dissimilar metals or, in certain circumstances, between different areas of the same metal or alloy component if there are differences in chemical composition and a resulting electrochemical potential between those areas. It should be remembered that metal dissolves at the anode while hydroxide ions (OH) congregate at the cathode. Therefore, it is the anode that corrodes and the determination of which metal acts as the anode is generally dependent on the positions of the metals in the tables illustrated above. When placed in electrical communication in an electrolyte such as seawater, the metals that are higher, in the tables shown above, as an associated metal in a galvanic circuit will tend to act as the cathode and the metals that are lower, in the tables shown above, will tend to act as the anode.

In order to fully understand and appreciate the advantages that are brought about by the preferred embodiments of the present invention, it is helpful to realize that in order for electrochemical reactions (such as galvanic corrosion) to occur, four components must be present and operative. These components include the anode, the cathode, the electron path, and the electrolyte. The anode is the site where electrons are produced and where metal loss occurs. The metal loses electrons which migrate from the metal surface and through the various electrical connections that provide the electron path to the cathode. The electrons remaining in the metal are free to move about in response to the voltage gradients present in the structure.

The cathode is the site where electrons are consumed. For each electron that is produced at the anode, an electron must be consumed at the cathode. In order for electrons to flow from the anode to the cathode, the electrons migrate through a metallic path between the two metals. A voltage differential causes the migration of electrons between the anode and the cathode. Electrons can move more easily through metals, but certain non-metallic materials, such as graphite, can serve this purpose. The electrolyte, such as seawater, conducts the electrical currents through the movement of charged chemical constituents that are referred to as ions. Positive and negative ions are present in equal amounts, with the positive ions tending to migrate away from the anode and toward the cathode and negative ions tending to migrate away from the cathode toward the anode.

In order to understand the advantageous operation of the various preferred embodiments of the present invention it is also helpful to understand a few basic facts relating to galvanic corrosion. It is important to understand that when galvanic corrosion occurs, electrons flow from the anode and are accepted by the cathode. The anode in the galvanic circuit is the metal that is more chemically active (lower in the tables shown above). These electrons flow through the external conducting path (the wire in FIG. 1). The more chemically active metal atoms become ions and move away from the anode and into the electrolyte where they typically can bond with oxygen ions to produce a metallic oxide, such as in the case of aluminum, aluminum oxide. The newly formed aluminum oxide molecules either drift away from the anode into the water or settle on the surface of the aluminum. In the example discussed above, the aluminum driveshaft housing would dissolve and eventually be destroyed through galvanic corrosion.

The important lesson to understand from the discussion above is that dissimilar metals, when connected in electrical communication with each other, can cause the transfer of electrons from the metal acting as the anode to the metal acting as the cathode. This, in turn, causes ions to be transferred between the metals through an electrolyte, such as seawater. As a result, galvanic corrosion can occur through this simple combination of dissimilar metals. As an example, if one end of a zinc wire is placed in contact with one end of a copper wire, and the opposite ends of both wires are placed in an electrolyte, current will flow and electrons will pass from the zinc wire to the copper wire at the junction where the two wires are in contact with each other. That result was originally discovered by Luigi Galvani in 1791 and illustrates the basic relationship between the anode and cathode in a galvanic circuit along with the electrolyte. The relationships between metals, as described above, are well known to those skilled in the art of marine vessels and the galvanic corrosion that can occur because of the numerous dissimilar metals involved in marine propulsion systems. In addition, the placement of those dissimilar metals in an electrolyte, such as seawater, and the relationship between these associations and galvanic corrosion is also well known to those skilled in the art.

Figure 2:
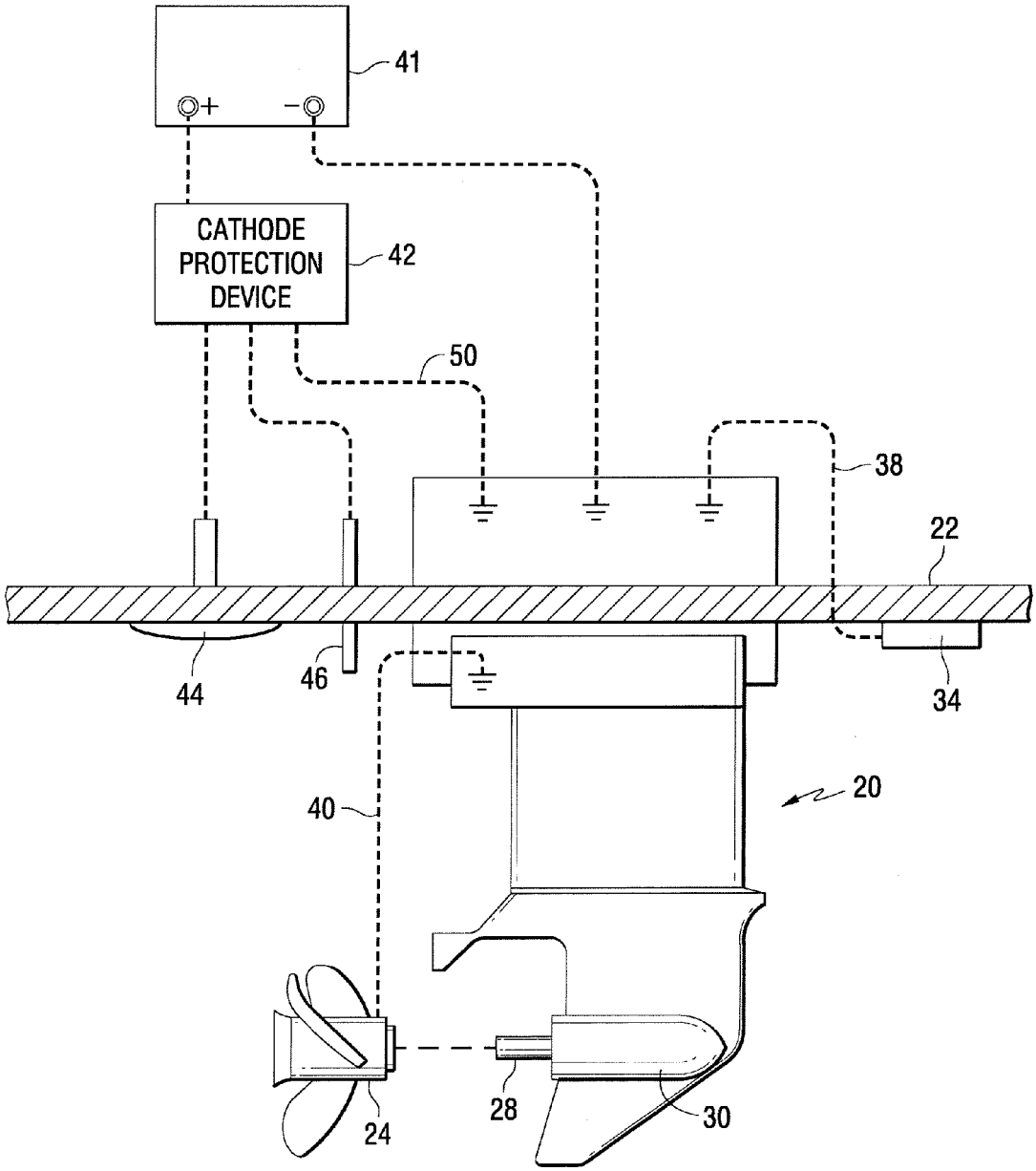
FIGS. 2-4 show a marine propulsion system with a drive extending through the hull of a marine vessel and corrosion prevention systems using both a sacrificial anode and a cathode protection device.

FIG. 2 shows a typical arrangement of various metals and components that are currently used to prevent or inhibit galvanic corrosion. U.S. Pat. No. 7,387,556 is described above and provides an example of the type of marine device which is illustrated schematically in FIGS. 2, 3 and 4 and used to show how the present invention can be adapted to that type of marine vessel. The schematic illustration in FIG. 2 shows a marine propulsion system in which a marine drive unit 20 is supported below the hull 22 of a marine vessel. Propulsion systems of this type are well known to those skilled in the art, and described in detail in U.S. Pat. No. 7,387,556, and the basic operation of the marine drive unit will not be described in detail herein. A propeller 24 is shown, in an exploded illustration, in order to also illustrate the relative location of the propeller shaft 28. The propeller shaft 28 is supported within a gear case 30 for rotation about a generally horizontal axis. A vertical driveshaft (not visible in FIG. 2) extends through the hull 22 and transmits torque from an engine that is disposed within the bilge of the marine vessel (not visible in FIG. 2) above the bottom surface 22 of the hull. When the propeller 24, which is commonly made of stainless steel, is mounted on the propeller shaft 28, the propeller is placed in electrical communication with the propeller shaft 28 and the gears and shafts contained within the marine propulsion unit 20. The driveshaft housing is typically made of bronze in applications such as that shown in FIG. 2, but it should be understood that driveshaft housings are commonly made of aluminum in other types of applications. Recognizing that the use of a stainless steel propeller 24 in combination with the bronze driveshaft housing 20 and gear case 30 can lead to galvanic corrosion, marine designers take various protective measures in order to avoid the damages that could otherwise occur through the operation of galvanic corrosion on marine systems such as that shown in FIG. 2.

With continued reference to FIG. 2, a sacrificial anode 34 is shown disposed within the same electrolyte (e.g. seawater) as the driveshaft housing 20 and the propeller 24. It operates to protect the bronze, or aluminum, portions of an associated driveshaft housing. In order to effectively perform its intended function, the sacrificial anode 34, which can typically be made of zinc, must be electrically connected to the driveshaft housing 20 which it is intended to protect. This is accomplished through the conductor 38 which connects the sacrificial anode 34 in electrical communication with the driveshaft housing 20, as symbolically represented by the dashed line 38 and the symbol which represents connection to the system ground. The propeller 24 is also shown symbolically connected to the driveshaft housing 20 by dashed line 40 and its associated ground symbol. A source of electrical power 41 is connected in electrical communication with the cathode protection device 42 and the other components shown in FIG. 2 as shown. This source of power 41 is also provided in FIGS. 3 and 4 although, for the purpose of simplicity, it is not specifically shown in those figures with associated lead lines.

With continued reference to FIG. 2, the propulsion system represented in the illustration also provides a cathode protection device 42 which uses an anode 44 in combination with a reference electrode 46 to impress a field on the protected component (e.g. the driveshaft housing 20) in order to inhibit its corrosion through the galvanic effects described above. A known type of cathode protection device 42 is commercially available and identified by the name "MerCathode". These devices are commercially available from Mercury Marine, a division of Brunswick Corporation, and provide a current that flows into the anode 44 to provide the impressed electric field that raises the potential of the protected component (e.g. the drive unit 20). The reference electrode 46 is used to measure that impressed field in order to properly control the magnitude of current provided to the anode 44. The cathode protection device 42 is also connected to the protected component as represented by dashed line 50.

For purposes of describing the problem addressed by the various embodiments of the present invention, the corrosion protection system provided by the cathode protection device 42 will be referred to as the primary corrosion protection device and the sacrificial anode 34 will be referred to as the secondary corrosion protection device. It is common to provide both the primary and secondary corrosion protection devices on the same marine vessel. However, the use of the two systems simultaneously, as is sometimes the case, can lead to certain problems. One of the problems that can result from the use of both primary and secondary corrosion protection systems, as described above in conjunction with FIG. 2 is that the sacrificial anode 34 and the cathode protection device 42 can compete with each other during their simultaneous operation instead of performing their functions as primary and backup secondary systems. For example, when the electrical potential of the sacrificial anode 34 is too high, it corrodes at an accelerated rate in order to protect the protected component (e.g. the bronze housing 20) and the effects of the cathode protection device 42 become insignificant. If the potential of the sacrificial anode 34 is too low, the cathode protection device 42 uses some of its output to protect the sacrificial anode 34 in addition to the protected device (e.g. the bronze or aluminum housing 20). This effectively removes some of the available capacity of the cathode protection device 42 to protect the drive unit housing. It is difficult to balance the effects of these two systems when used on a common marine vessel. In most applications, the potential of the sacrificial anode 34 is either too high or too low and, as a result, situations are created in which the cathode protection device 42 either does very little work in protecting the housing or its potential is too low and the cathode protection device 42 uses some of its available capacity in protecting the sacrificial anode 34.

With reference to Table III shown above, when two or more of the materials, or the cathode protection device 42 are electrically connected and immersed in seawater as an electrolyte, the higher potential material corrodes to protect the lower potential materials. In one exemplary system, either a zinc or aluminum-indium sacrificial anode 34 has been connected in combination with a MerCathode system, a bronze driveshaft housing and a stainless steel propeller. In that case, the zinc or aluminum-indium sacrificial anode corroded at an unacceptably high rate and, as a result, the MerCathode device did little work to protect the bronze driveshaft housing 20 and the stainless steel propeller 24. When an aluminum-gallium sacrificial anode is used in combination with a Mer- Cathode device, a bronze housing, and a stainless steel propeller, the MerCathode system protects the bronze housing, stainless steel propeller, and aluminum-gallium sacrificial anode. However, as should be understood from the above discussion, the use of a cathode protection device 42, such as a MerCathode device, in this way can be inefficient because the MerCathode device uses some of its available capacity and electrical power in protecting the sacrificial anode and therefore has less available capacity to protect the much more expensive bronze housing and stainless steel propeller. This is particularly critical in situations where flowing water exists and the MerCathode device has reached the limits of its capacity. It must be remembered that the MerCathode unit, or alternative cathode protection device 42, uses electric power, in the form of a DC current obtained from a battery, to impress the voltage potential that protects the bronze housing.

In order to overcome the problems described above and also make use of the concept of having a primary and secondary system of corrosion prevention, the preferred embodiments of the present invention disable either the primary or secondary systems at appropriate times determined as a function of the operability of the cathode protection device 42. If it is determined that the cathode protection device 42, such as a MerCathode unit, is not operating properly, it is disabled and the sacrificial anode 34 is connected. If the MerCathode device is operating correctly, but not able to provide sufficient output, it remains enabled and the sacrificial anode is also connected to provide additional protection.

Figure 3:
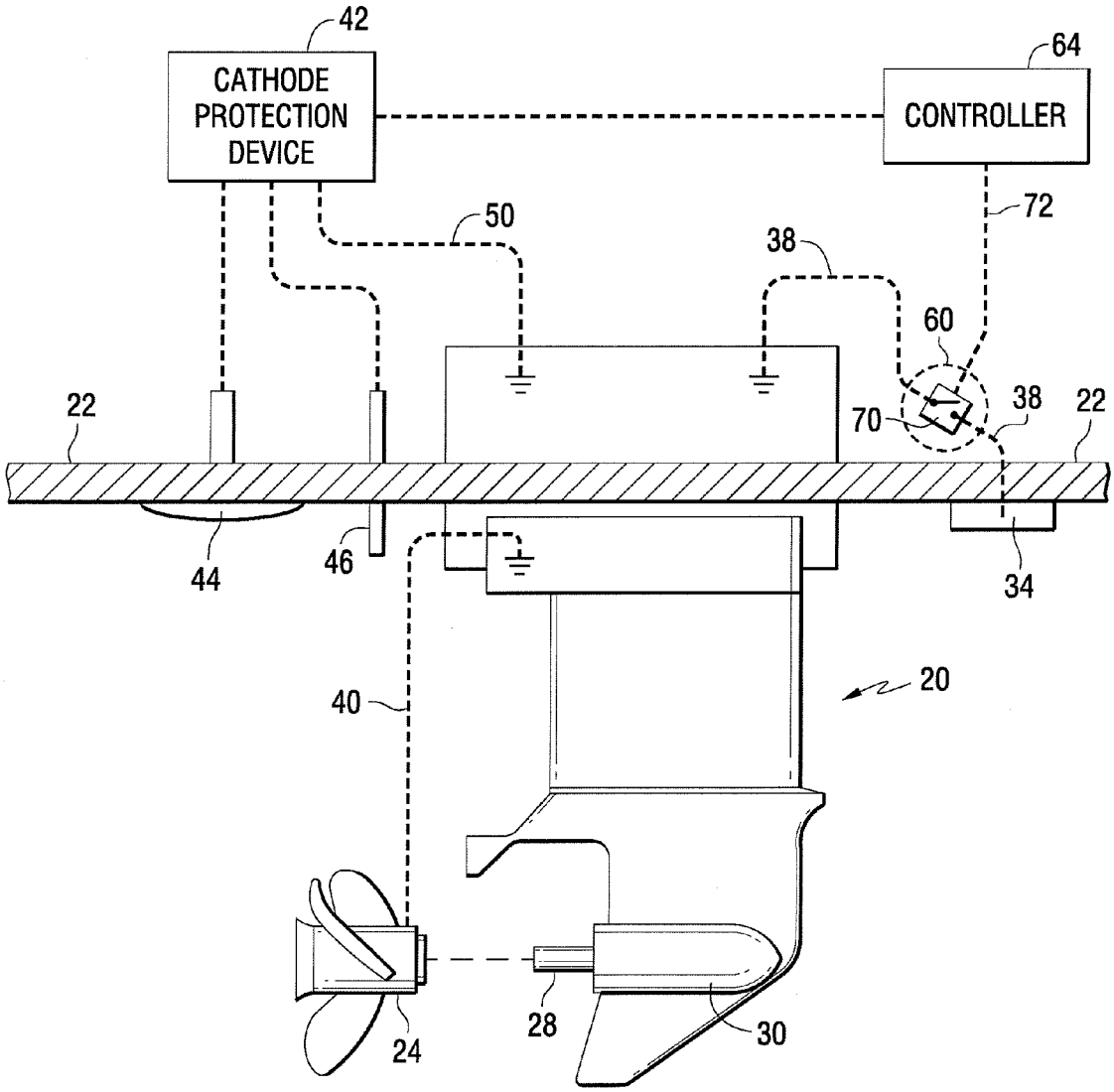

FIG. 3 is generally similar to FIG. 2, but with one of the preferred embodiments of the present invention included in the corrosion protection system. A continuity controller 60 is connected in electrical communication with the electrical conductor 38 which extends between the sacrificial anode 34 and the system ground of the device to be protected, such as the housing 20. In addition, a controller 64 is included for the purpose of controlling the operation of the continuity controller 60 and the cathode protection device 42. The particular embodiment shown in FIG. 3 uses a switch 70, or relay, that is controlled by the controller as represented by dashed line 72. When the controller 64 determines that the cathode protection device 42 is not operating effectively, it can disable the cathode protection device 42, such as the MerCathode unit, by closing the switch 70 in order to connect the sacrificial anode 34 to the circuit that includes the device to be protected such as the housing 20. The controller 64 (which can comprise a microprocessor) also provides a signal which disables the cathode protection device 42 simultaneously with the connection of the sacrificial anode 34 to the system. When the cathode protection device 42 is operating properly, the switch 70 is opened so that no return path (i.e. line 38) for electrons is available to the sacrificial anode 34. As a result, the sacrificial anode 34 is not included in a galvanic circuit and, as a result, is not degraded. Examples that would result in the controller 64 disabling the cathode protection device 42 are twofold. The first would be if an associated battery which is dependent on for electric power to cathode protection device 42 is determined to be discharged. The second would be a disruption in the incoming power supply. It should be understood that other types of improper operation can also lead the controller 64 to disable the cathode protection device 42 and connect the sacrificial anode 34 to the circuit. When this occurs, the controller 64 may disable the cathode protection device and provides an alarm signal to notify the operator of the marine vessel that the sacrificial anode 34 is currently being used to inhibit corrosion. This typically would notify the operator of the marine vessel that some type of corrective action is necessary and, in addition, that the sacrificial anode 34 is currently being corroded during the performance of its protection function.

Figure 4:
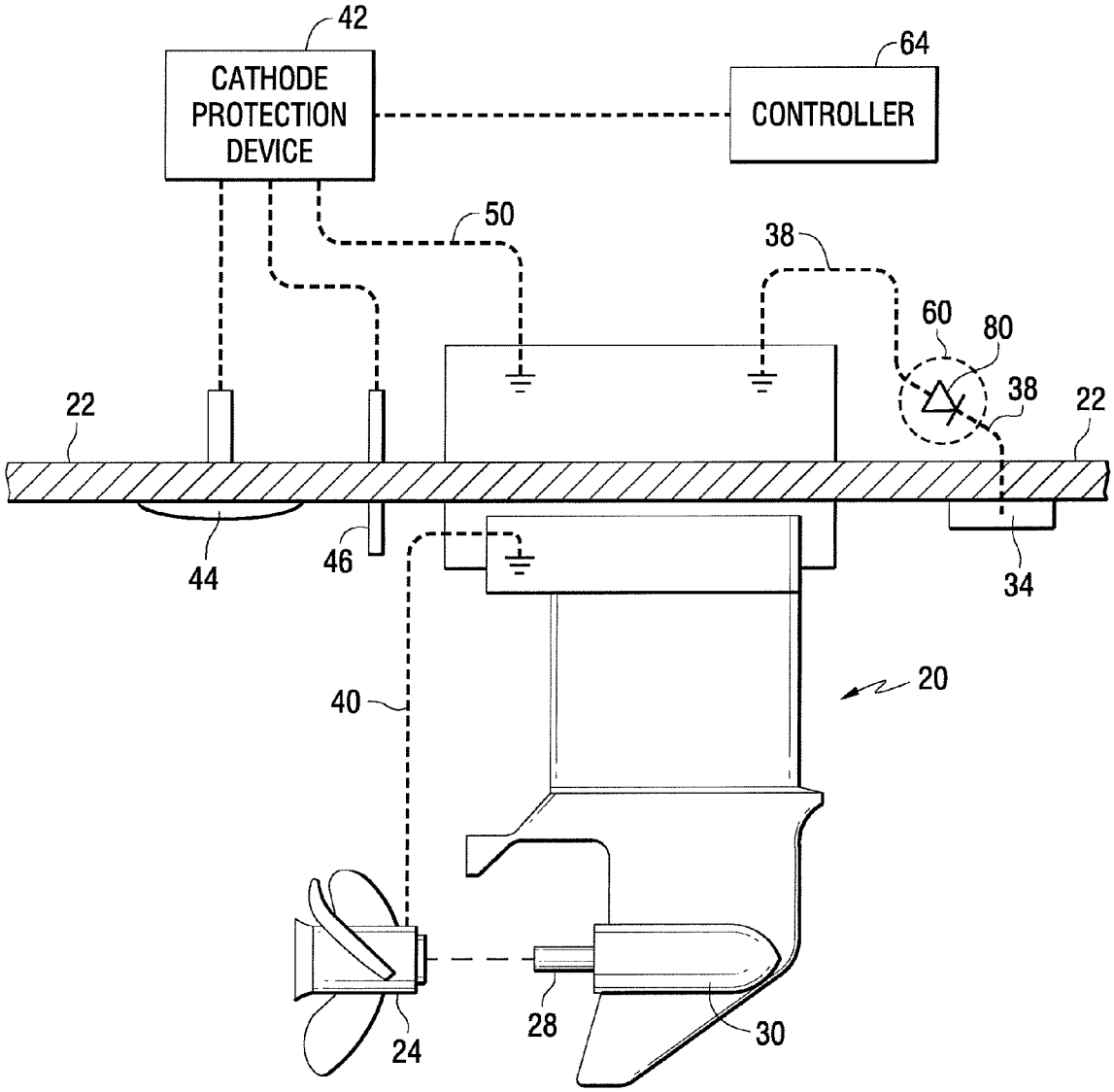

The embodiment of the present invention shown in FIG. 4 incorporates a diode 80 for use as the continuity controller 60 instead of the switch described above in conjunction with FIG. 3. Essentially, when the MerCathode system is operating properly, there exists an insufficient potential to overcome the forward drop of the diode 80. If the MerCathode, or other type of cathode protection device 42, is not operating properly or loses power for some reason, the potential becomes sufficient to overcome the diode 80 and this connects the sacrificial anode 34 to the system. In other words, the conductor 38 becomes operative to conduct those electrons instead of the protected device, such as the drivehousing 20. To assure this conduction, the controller 64 can be configured to deactivate the cathode protection device 42 completely when a malfunction of any type is detected. The basic concept of this embodiment is that the electron path 38 is disrupted to eliminate the circuit containing the sacrificial anode 34.

With continued reference to FIG. 4, if the cathode protection device 42 is active and working properly, the electrode 44 provides a field of approximately 0.940 volts and the zinc has an electrode voltage of approximately 1.0 volts. The difference between the voltage provided by the MerCathode system and that provided by the zinc anode is approximately 0.06 volts which is insufficient to overcome the forward bias of the diode 80. Therefore, the diode remains non-conductive and the sacrificial anode 34 remains out of the circuit. If the cathode protection device 42 is deactivated or fails to provide the 0.940 volts at its electrode, the zinc anode 34 is able to produce sufficient voltage, under most circumstances, to overcome the bias of the diode 80 and current can flow through conductor 38.

With continued reference to FIG. 4, it should also be noted that the diode 80 also provides a way of adjusting the output potential of the sacrificial anode 34. With one diode 80 in the system, the voltage at the anode becomes equal to the alloy potential (e.g. 1.0 volts for zinc) minus a single voltage drop (e.g. 0.94 volts). With two diodes connected in series in line 38, the voltage becomes equal to the alloy potential minus two voltage drops. The anode 34 will therefore be consumed at a slower rate if the anode voltage is closer to the material that is being protected.

As described above, U.S. Pat. No. 4,322,633, which issued to Staerzl on Mar. 30, 1982, describes a marine cathodic protection system such as the one identified by reference numeral 42 and illustrated in FIGS. 2, 3 and 4. The two preferred embodiments, which use the switch 70 and diode 80, will be further described below in conjunction with the system described in that patent. In other words, if the preferred embodiments of the present invention are adapted for use in conjunction with a system generally similar to that described in the Staerzl patent, the arrangements of those two embodiments would be generally similar to those illustrated in FIGS. 5 and 6 and described below.

Figure 5:
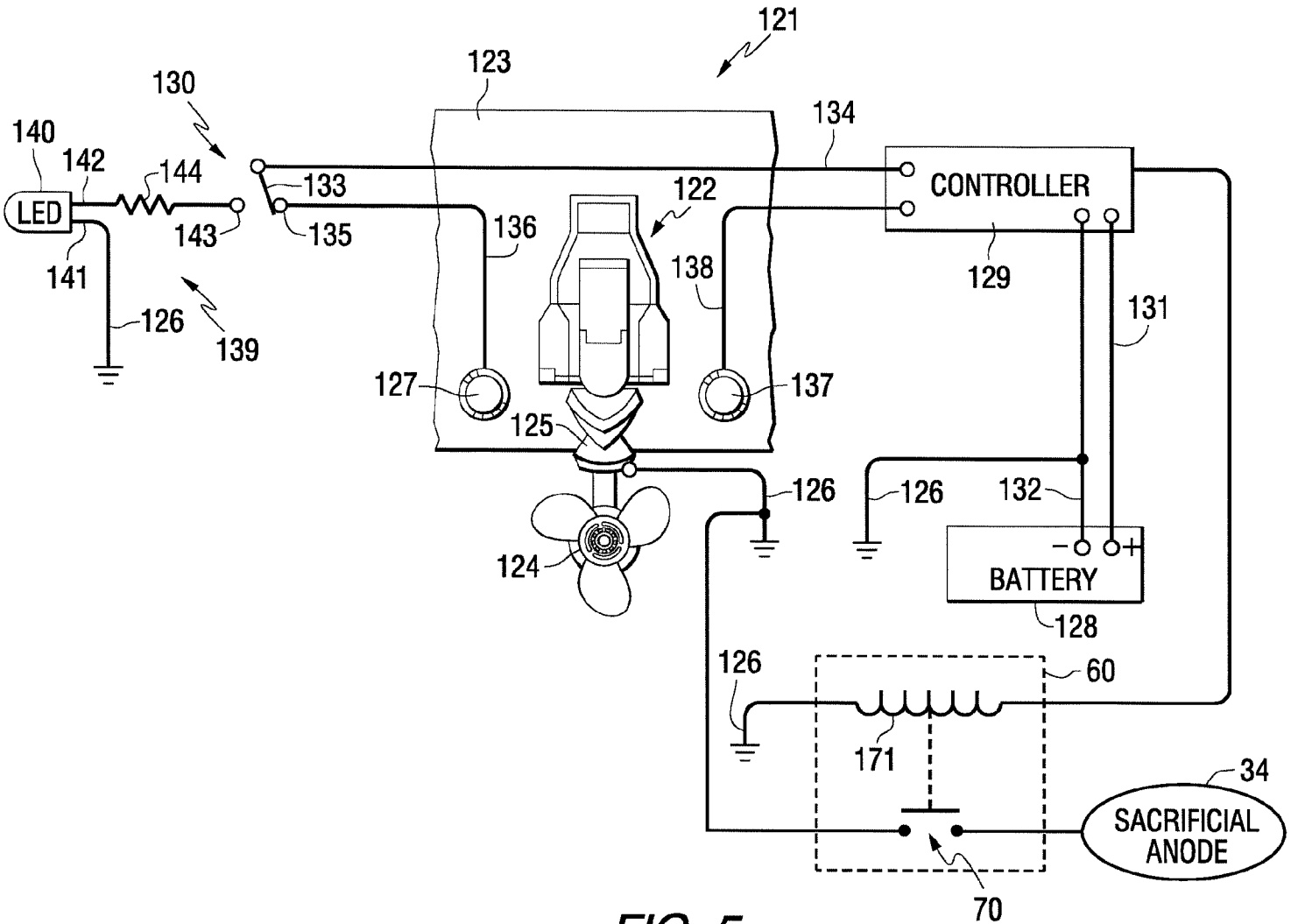
FIGS. 5 and 6 show two embodiments of the present invention incorporated with a previously known cathodic protection system.

With reference to FIG. 5, the marine transportation system 121 is partially illustrated and includes a marine drive unit 122 connected to a boat transom 123. The drive unit 122 includes a propeller 124 rotatably mounted to a housing 125 and is selectively operated by an engine (not shown in the figure) to control the position and movement of the marine vessel in water. It should be understood that the drive unit 122 may be any typical form of marine propulsion device, such as an outboard engine or sterndrive system, or a propulsion system in which the drive unit is supported directly below the hull of a marine vessel as described above and as disclosed in the Davis patent described above. The drive unit 122, or portions thereof, can be formed of bronze or aluminum or other suitable metals and forms a common ground as illustrated at 126 for the electrical circuit of the cathodic protection system. An anode 127 is connected in electrical isolation to the transom 123 and receives energizing power from a battery 128 as supplied through a controller 129 and a test control switch 130. Thus, the positive battery terminal is connected to the controller 129 through a connecting circuit 131 while the negative battery terminal is connected through a circuit 132 to the system ground 126 and to the controller 129. A switch arm 133 of switch 130 is connected to the controller 129 through a connecting circuit 134 while a terminal 135 of switch 130 is connected to the anode 127 through a connecting circuit 136. A reference anode 137 is connected in electrical isolation to the transom 123 and provides a sensed potential signal to the controller 129 through a connecting circuit 138. The test circuit 139 includes a light emitting diode (LED) 140 having one terminal 141 connected to the system ground 126 and an energizing terminal 142 connected to a terminal 143 of switch 130 through a connecting resistor 144. In operation, the anode 127 and the reference electrode 137 are positioned below the water line adjacent to the housing 125 and propeller 124. The controller 129 responds to the sensed potential signal received from the reference electrode 137 and supplies energizing current through the circuit 134 and switch 130 to energize the anode 127 to provide and maintain a protective polarization at the drive unit 122 to retard or prevent corrosive action which might otherwise be caused by the water or elements therein. The controller 129 functions to maintain a substantially constant polarization potential at the drive unit 122 when operating within a prescribed current conducting condition. The switch arm 133 may be selectively transferred from contact 135 to contact 143 to perform a test sequence. In such condition, the flow of energizing power from the controller 129 through connecting circuit 134 energizes the LED 140 to signify that the controller 129 is operating properly. An integrated circuit within the controller 129 is of the type which may be commercially purchased from any one of a number of manufacturing sources, such as Texas Instruments, for example, under the designation uA723C. The operation of the integrated circuit within the controller 129 is described in detail in U.S. Pat. No. 4,322,633 and will not be described herein. The controller 129 is also configured to control the operation of the continuity controller 60 which, in this instance, comprises the switch 70. This switch 70 connects or disconnects the sacrificial anode 34 to the circuit. By energizing coil 171, the sacrificial anode 34 can be connected to the circuit when the controller 129 determines that the MerCathode system is not operating properly. In the embodiments described above in conjunction with FIGS. 2-4, the controller 64 could perform this function. Although not described in detail above, the controller 64 would typically be provided with a microprocessor that is able to receive signals from the cathodic protection device 42, which is functionally similar to the controller 129 in FIG. 5, and control the operation of the continuity controller 60.

Figure 6:
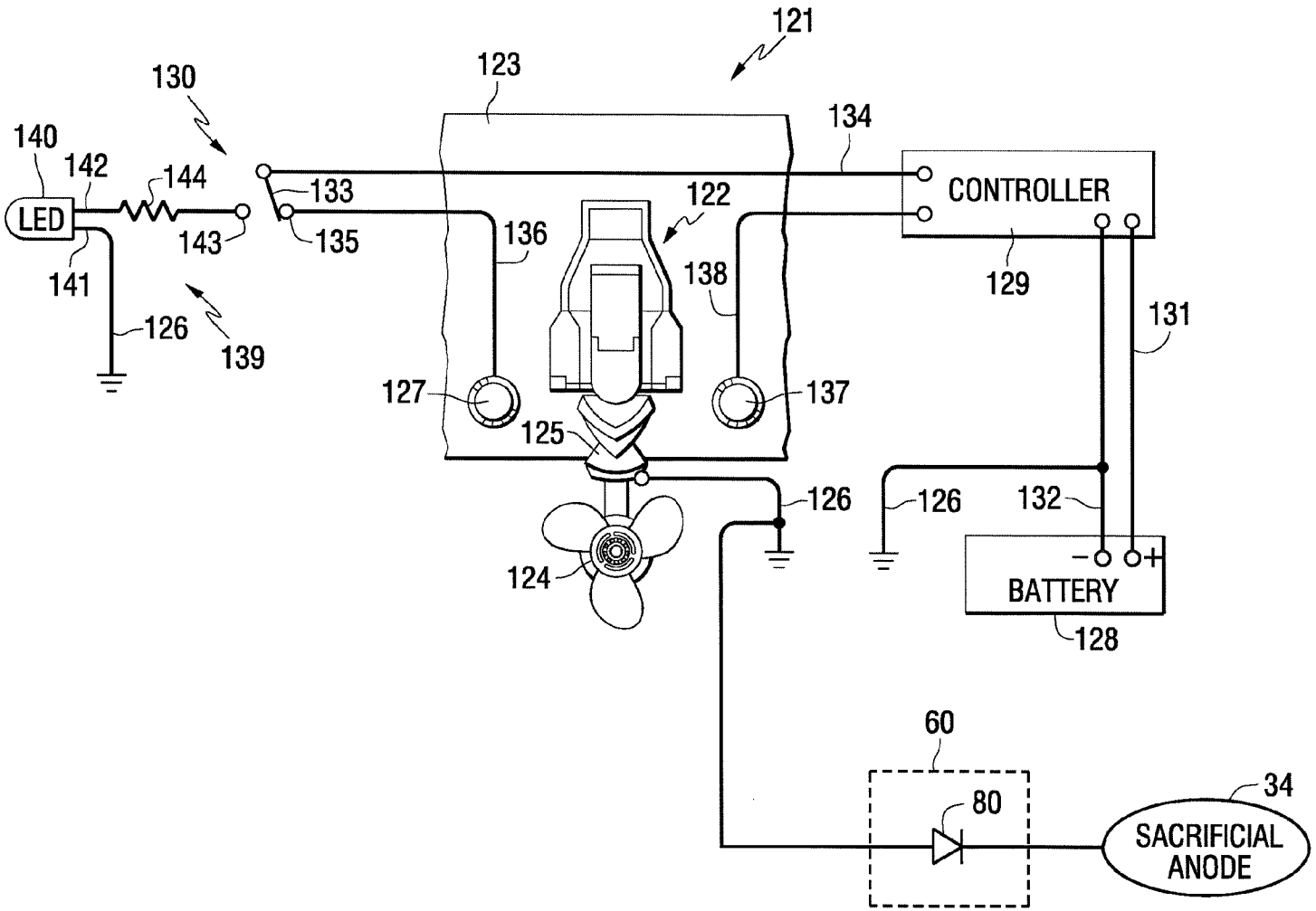

The embodiment of the present invention shown in FIG. 6 illustrates the use of a diode 80 as the continuity controller 60. The remaining portion of FIG. 6 is generally similar to that described above in conjunction with FIG. 5 and will not be described again. The purpose of FIGS. 5 and 6 is to show the application of the various embodiments of the present invention in conjunction with a system that incorporates a cathode protection device 42, such as a MerCathode system that is available in commercial quantities from Mercury Marine and which is well known to those skilled in the art. The preferred embodiments of the present invention allow two corrosion prevention systems to be used as primary and secondary systems on the same marine vessel without experiencing the negative results that can otherwise occur when the two systems are not perfectly balanced. These problems are described in detail above. The preferred embodiments of the present invention provide a corrosion inhibiting system that comprises a cathodic protection device 42 configured to maintain a marine propulsion unit 20 at a selected potential by supplying electrical energy from a direct current source 128 to a submergible electrode 44 adjacent to the marine propulsion unit 20, wherein the marine propulsion unit 20 is made of a first material, such as bronze or aluminum. It also comprises a submergible anode 34 made of a second material, wherein the first and second materials are dissimilar materials. The second material is selected to act as a sacrificial anode 34 and to cathodically protect the first material when the first and second materials are connected together in electrical communication. An electrical conductor 38 is connected in electrical communication between the first material of the marine propulsion unit 20 and the second material of the sacrificial anode 34. A continuity controller 60 is connected in electrical communication with the electrical conductor 38 between the first material of the marine propulsion unit and the second material of the submergible anode 34. In certain embodiments of the present invention, the electrical conductor 38 comprises an electrically conductive cable which extends at least partially between the first and second materials. The continuity controller 60 can be a switch 70 which is controllable as a function of the operability of the cathodic protection device 42 and the cathodic protection device 42 can be configured to open the switch 70 to disconnect the submergible anode 34 from the marine propulsion unit 20 when the cathodic protection device 42 is operating effectively to maintain the marine propulsion unit at the selected potential. The cathodic protection device 42 can also be configured to close the switch 70 to connect the submergible anode 34 in electrical communication with the marine propulsion unit 20 when the cathodic protection device is not maintaining the marine propulsion unit at the selected potential. The cathodic protection device is configured to cease to maintain a marine propulsion unit at the selected potential when the switch is closed. In other words, the cathode protection device can be deactivated by the controller when the continuity controller causes the submergible anode to be connected to the system for the purpose of acting as a sacrificial anode. The continuity controller 60 can be a diode 80 which is configured to limit the magnitude of electric current flowing to the submergible anode as a function of the relative potentials of the submergible marine propulsion unit 20 and the submergible diode 34. The first material can be a metal selected from the group consisting of bronze or aluminum and the second material can be a metal selected from the group consisting of zinc, magnesium, and aluminum. The system can further comprise a signal device configured to provide notification of the continuity controller being activated to connect the submergible anode in electrical communication with the marine propulsion unit.

Although the present invention has been described in particular detail and illustrated to show certain preferred embodiments, it should be understood that alternative embodiments are also within its scope.

We claim:

1. A corrosion inhibiting system, comprising:

a cathodic protection device configured to maintain a marine propulsion unit at a selected potential by supplying electrical energy from a direct current source to a submergible electrode located adjacent to said marine propulsion unit, said marine propulsion unit being made of a first material;

a submergible anode made of a second material, said first and second materials being dissimilar materials, said second material being selected to act as a sacrificial anode and cathodically protect said first material when said first and second materials are connected together in electrical communication;

an electrical conductor connected in electrical communication between said first material of said marine propulsion unit and said second material of said submergible anode;

a continuity controller connected in electrical communication with said electrical conductor between said first material of said marine propulsion unit and said second material of said submergible anode.

2. The system of claim 1, wherein:

said electrical conductor comprises an electrically conductive cable which extends at least partially between said first and second materials.

3. The system of claim 1, wherein:

said continuity controller is a switch which is controllable as a function of the operability of said cathodic protection device.

4. The system of claim 3, wherein:

said cathodic protection device is configured to open said switch to disconnect said submergible anode from said marine propulsion unit when said cathodic protection device is operating effectively to maintain said marine propulsion unit at said selected potential.

5. The system of claim 3, wherein:

said cathodic protection device is configured to close said switch to connect said submergible anode in electrical communication with said marine propulsion unit when said cathodic protection device is not maintaining said marine propulsion unit at said selected potential.

6. The system of claim 3, wherein:

said cathodic protection device is configured to cease to maintain a marine propulsion unit at said selected potential when said switch is closed.

7. The system of claim 1, wherein:

said continuity controller is a diode which is configured to limit the magnitude of an electric current flowing to said submergible anode as a function of the relative potentials of said submergible marine propulsion unit and said submergible anode.

8. The system of claim 1, wherein:

said first material is a metal selected from the group consisting of brass, bronze, aluminum, stainless steel, and steel.

9. The system of claim 1, wherein:

said second material is a metal selected from the group consisting of zinc, magnesium, and aluminum.

10. The system of claim 1, further comprising:

a signal device configured to provide notification of said continuity controller being activated to connect said submergible anode in electrical communication with said marine propulsion unit.

11. A corrosion inhibiting system, comprising:

a primary corrosion protection device configured to maintain a marine propulsion unit at a selected potential, said marine propulsion unit being made of a first material;

a secondary corrosion protection device made of a second material selected to act as a sacrificial anode, said first and second materials being dissimilar materials;

an electrical conductor connected in electrical communication between said first material of said marine propulsion unit and said second material of said secondary corrosion protection device; and a continuity controller connected in electrical communication with said electrical conductor between said first material of said marine propulsion unit and said second material of said secondary corrosion protection device.

12. The system of claim 11, wherein:

said primary corrosion protection device is configured to maintain said marine propulsion unit at said selected potential by supplying electrical energy from a direct current source to a submergible electrode located adjacent to said marine propulsion unit, said secondary corrosion protection device is a submergible anode, said second material being selected to act as a sacrificial anode and cathodically protect said first material when said first and second materials are connected together in electrical communication, said electrical conductor comprises an electrically conductive cable which extends at least partially between said first and second materials.

13. The system of claim 12, wherein:

said continuity controller is a switch which is controllable as a function of the operability of said cathodic protection device, said cathodic protection device being configured to open said switch to disconnect said submergible anode from said marine propulsion unit when said cathode protection device is operating effectively to maintain said marine propulsion unit at said selected potential, said cathodic protection device being configured to close said switch to connect said submergible anode in electrical communication with said marine propulsion unit when said cathode protection device is not maintaining said marine propulsion unit at said selected potential.

14. The system of claim 13, wherein:

said cathodic protection device is configured to cease to maintain a marine propulsion unit at said selected potential when said switch is closed.

15. The system of claim 12, wherein:

said continuity controller is a diode which is configured to limit the magnitude of an electric current flowing to said submergible anode as a function of the relative potentials of said submergible marine propulsion unit and said submergible anode.

16. The system of claim 12, wherein:

said first material is a metal selected from the group consisting of brass, bronze, aluminum, stainless steel, and steel and said second material is a metal selected from the group consisting of zinc, magnesium, and aluminum.

17. The system of claim 11, further comprising:

an alarm device configured to provide notification of said continuity controller being activated to connect said submergible anode in electrical communication with said marine propulsion unit.

18. A corrosion inhibiting system, comprising:

a cathodic protection device configured to maintain a marine propulsion unit at a selected potential by supplying electrical energy from a direct current source to a submergible electrode located adjacent to said marine propulsion unit, said marine propulsion unit being made of a first material;

a submergible anode made of a second material, said first and second materials being dissimilar materials, said second material being selected to act as a sacrificial anode and cathodically protect said first material when said first and second materials are connected together in electrical communication;

an electrical conductor connected in electrical communication between said first material of said marine propulsion unit and said second material of said submergible anode, said electrical conductor comprising an electrically conductive cable which extends at least partially between said first and second materials;

a continuity controller connected in electrical communication with said electrical conductor between said first material of said marine propulsion unit and said second material of said submergible anode; and a signal device configured to provide notification of said continuity controller being activated to connect said submergible anode in electrical communication with said marine propulsion unit.

19. The system of claim 18, wherein:

said continuity controller is a switch which is controllable as a function of the operability of said cathodic protection device, said cathodic protection device being configured to open said switch to disconnect said submergible anode from said marine propulsion unit when said cathode protection device is operating effectively to maintain said marine propulsion unit at said selected potential, said cathodic protection device being configured to close said switch to connect said submergible anode in electrical communication with said marine propulsion unit when said cathode protection device is not maintaining said marine propulsion unit at said selected potential.

20. The system of claim 19, wherein:

said continuity controller is a diode which is configured to limit the magnitude of an electric current flowing to said submergible anode as a function of the relative potentials of said submergible marine propulsion unit and said submergible anode.

* * * * *